United States Patent [19]

Watanabe et al.

[11] 4,119,385

[45] Oct. 10, 1978

[54] RIBBON CHANGING MECHANISM FOR A TYPEWRITER

[75] Inventors: Tomoyoshi Watanabe; Tsuneo Yasui, both of Chiryu; Shigeo Ishikawa, Hazu; Kiyomichi Okada, Ama, all of Japan

[73] Assignee: Brother Kogyo Kabushiki Kaisha, Nagoya, Japan

[21] Appl. No.: 712,007

[22] Filed: Aug. 5, 1976

[30] Foreign Application Priority Data

Aug. 6, 1975 [JP] Japan ..... 50/96200

[51] Int. Cl.[2] ..... B41J 33/56

[52] U.S. Cl. ..... 400/215.3; 400/216.1; 400/248.2; 400/693.1

[58] Field of Search ..... 197/157, 158, 159, 186 R, 197/170

[56] References Cited

U.S. PATENT DOCUMENTS

| | | | |
|---|---|---|---|
| 1,456,302 | 5/1923 | Dobson | 197/159 |
| 1,467,942 | 9/1923 | Kurowski | 197/170 X |
| 1,665,736 | 4/1928 | Going | 197/157 X |
| 2,344,118 | 3/1944 | Wunderlich | 197/186 R |
| 2,822,909 | 2/1958 | Roy | 197/170 |
| 2,919,784 | 1/1960 | Morris | 197/159 |
| 2,984,329 | 5/1961 | Poirier | 197/170 X |
| 3,062,351 | 11/1962 | Canny | 197/170 X |
| 3,123,196 | 3/1964 | Paone et al. | 197/186 R |
| 3,180,572 | 4/1965 | Gallant | 197/186 R UX |
| 3,191,742 | 6/1965 | Harmon | 197/186 R |

FOREIGN PATENT DOCUMENTS

| | | | |
|---|---|---|---|
| 246,005 | 12/1947 | Switzerland | 197/170 |

*Primary Examiner*—Ernest T. Wright, Jr.
*Attorney, Agent, or Firm*—George B. Oujevolk

[57] ABSTRACT

In a ribbon changing mechanism, a ribbon retaining portion of the ribbon vibrator lifts a printing ribbon from a lowered non-printing position to an elevated printing position, in response to the printing operation. When a push button is depressed for retaining an actuating lever in a first position where said ribbon vibrator is shifted to a ribbon changing position, the ribbon vibrator connected to the actuating lever is moved upward from the lowered non-printing position to the ribbon changing position, independently of the printing operation and retained in the ribbon changing position. The ribbon retaining portion is comprised of a rear ribbon retaining member and a front ribbon retaining member, which defines a pair of ribbon passages having closed top and bottom portions in combination with both ribbon retaining members. The actuating lever is operatively connected to an opener shaft, so that when the push button is depressed, the opener shaft may be brought into engagement with the front ribbon retaining member, and then the top portions of the ribbon passages are opened. By depressing the push button, a top cover of the typewriter is moved to an open position. If the top cover is brought into a closed position, the actuating lever is returned to the second position, whereas the top portions of the ribbon passages are closed.

4 Claims, 9 Drawing Figures

RIBBON CHANGING MECHANISM FOR A TYPEWRITER

BACKGROUND OF THE INVENTION

This invention relates to a ribbon changing mechanism for a typewriter and more particularly relates to a mechanism for lifting the ribbon vibrator to a ribbon changing position, opening the top portion of the ribbon passage of the ribbon vibrator and moving the top cover to an open position by depressing a push button, and when the top cover is manualy returned to its closed position, the ribbon vibrator is returned to its lowered non-printing position and the top portion of the ribbon passage is closed.

DESCRIPTION OF THE PRIOR ART

A typewriter in common use has been such that there is provided a ribbon vibrator having a ribbon retaining portion, which ribbon vibrator is adapted to vertically move between a lifted printing position in front of a printing point on a platen and a lowered non-printing position situated below the lifted printing position, in response to the printing operation, and a ribbon wound on spools or accomodated in a ribbon cartridge is inserted into the ribbon retaining portion of the ribbon vibrator, so that the ribbon may be guided from the lowered non-printing position of the lifted printing position in association with the printing operation. The ribbon retaining portion of the ribbon vibrator is maintained normally in the lowered non-printing position within the typewriter unless the printing operation is effected. When it is desired to remove a used ribbon from the ribbon vibrator and insert a new one thereto, such as for exchange of an old ribbon for a new one, a machine operator has to insert his fingers into a confined space. This makes exchange of a ribbon for another difficult and troublesome.

OBJECT OF THE INVENTION

It is accordingly a primary object of the present invention to provide a ribbon changing mechanism, wherein the ribbon vibrator is moved from a lowered non-printing position to ribbon changing position above the lowered position and retained therein only by manipulating a push button which constitutes part of a first operating means, whereby exchange of a used ribbon for a new one is facilitated.

It is another object of the present invention to provide a ribbon changing mechanism, wherein the ribbon retaining portion of the ribbon vibrator is comprised of a rear ribbon retaining member and a front ribbon retaining member, which defines a ribbon passage having a closed top and bottom portion in combination with both ribbon retaining members, the front ribbon retaining member being adapted to be turned in a direction to open the top portion of the ribbon passage, when the first operating means is depressed, thereby facilitating removal or insertion of a ribbon from or into the ribbon retaining portion of the ribbon vibrator.

It is a further object of the present invention to provide a ribbon changing mechanism. When the first opening means is actuated, a top cover of the typewriter being urged by a spring means to an open position with respect to the machine frame is released from engagement with a latching member, thereby the top cover is moved to an open position, whereby exchange of a ribbon for a new one is facilitated, and when the top cover is manualy returned to a closed position relative to the machine, the ribbon vibrator is moved from the ribbon changing position to the lowered non-printing position by a second operating means including the top cover, whereby simplicity in the procedures incidental to the ribbon exchange results.

SUMMARY OF THE INVENTION

According to the inventive concept there is provided a ribbon changing mechanism for typewriters in which a ribbon retaining portion of the ribbon vibrator lifts a printing ribbon from a lowered non-printing to an elevated position, in response to the printing operation. When a push button is depressed for retaining an actuating lever in a first position where the ribbon vibrator is shifted to a ribbon changing position, the ribbon vibrator connected to the actuating lever is moved upward from the lowered non-printing position to the ribbon changing position, independently of the printing operation and retained in the ribbon changing position. The ribbon retaining portion is comprised of a rear ribbon retaining member and a front ribbon retaining member, which defines a pair of ribbon passages having closed top and bottom portions in combination with both ribbon retaining members. The actuating lever is operatively connected to an opener shaft, so that when the push button is depressed, the opener shaft may be brought into engagement with the front ribbon retaining member, and then the top portions of the ribbon passages are opened. By depressing the push button, a top cover of the typewriter is moved to an open position. If the top cover is brought into a closed position, the actuating lever is returned to the second position, whereas the top portions of the ribbon passages are closed.

These and other objects and features of the present invention will be apparent from the ensuing part of the specification in conjunction with the drawing, which indicates a preferred embodiment.

DETAILED DESCRIPTION OF THE INVENTION

Figure 1:
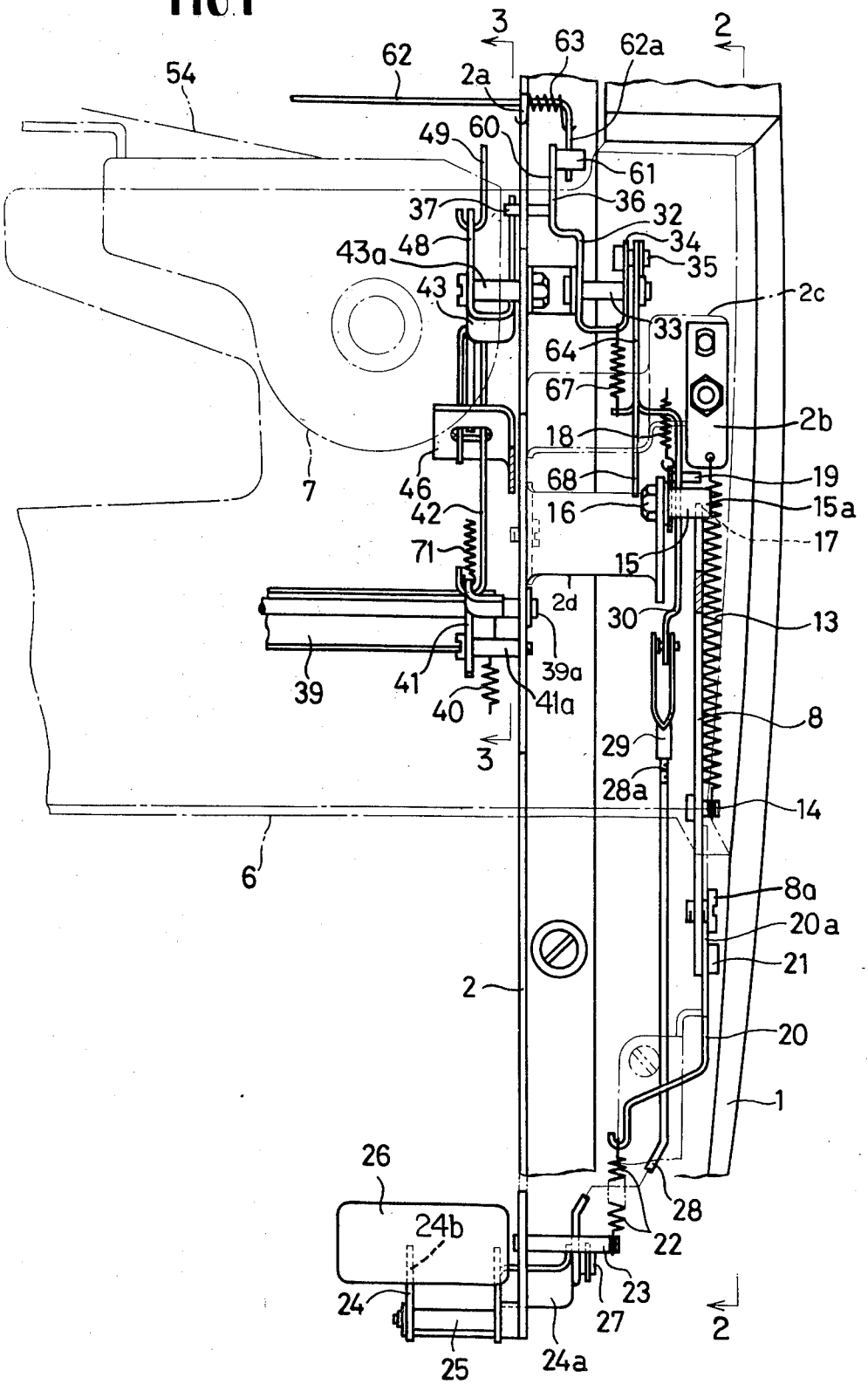
FIG. 1 is a fragmentary plan view of a ribbon changing mechanism of a typewriter, shown with a top cover omitted.
Figure 2:
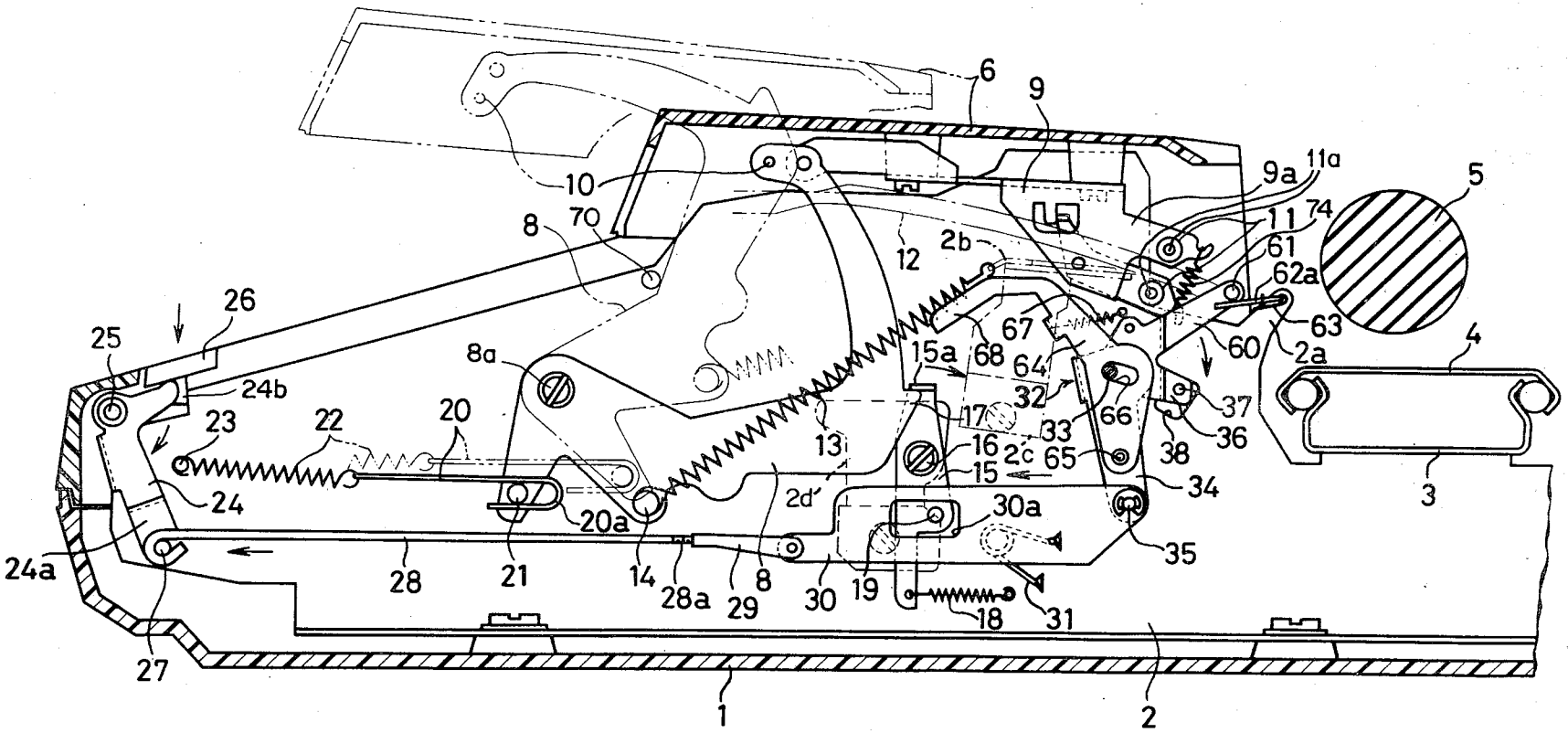
FIG. 2 is a cross sectional view taken along the line 2—2 of FIG. 1.
Figure 3:
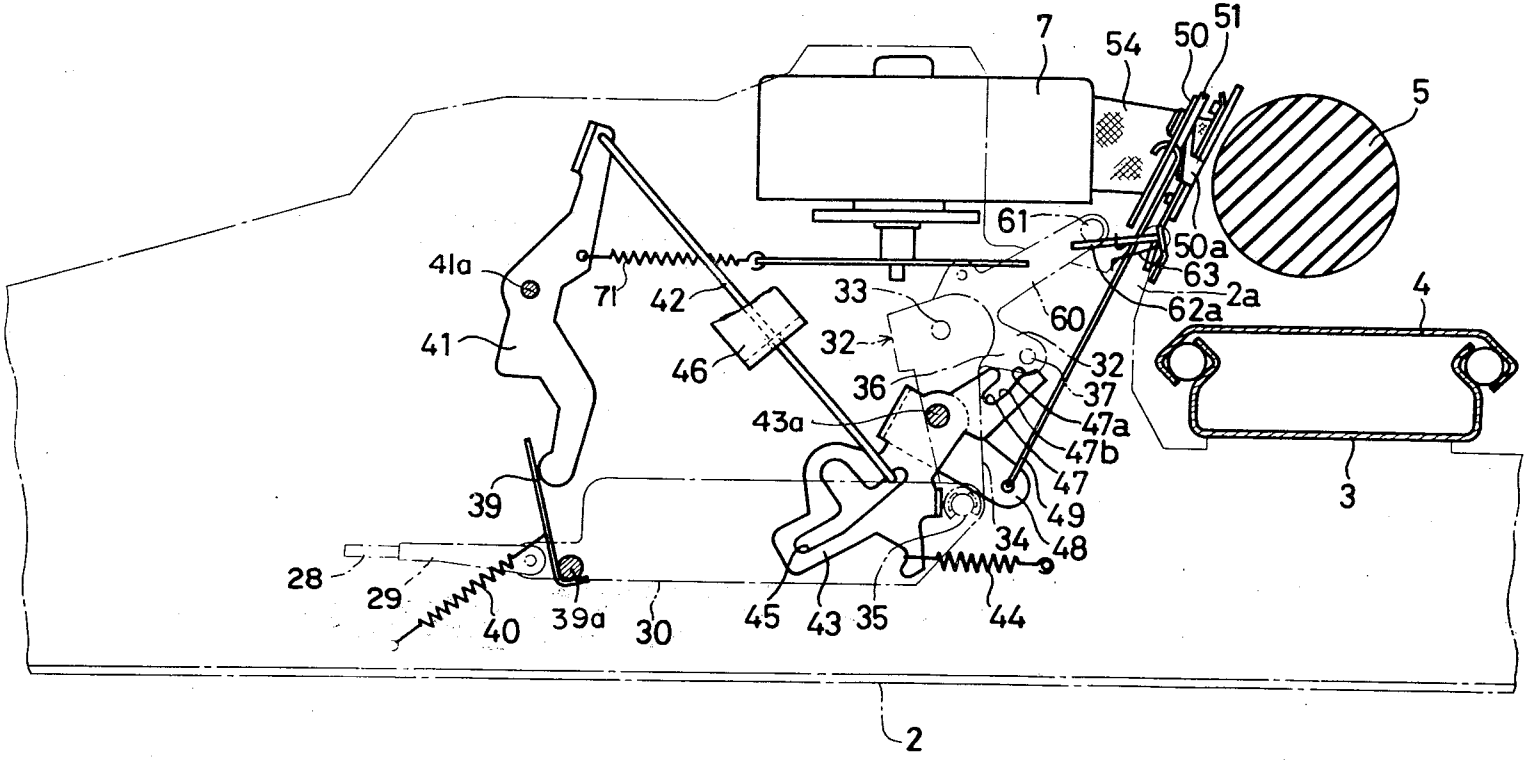
FIG. 3 is a cross sectional view taken along the line 3—3 of FIG. 1.

Referring to the drawing, internal mechanisms of the typewriter are covered with a cover 1 which composes a part of a machine frame. A pair of side frames 2 which are part of a machine frame are the left and right sides as viewed from a machine operator, and for explanatory convenience, the right hand side frame 2 alone is shown in FIGS. 1, 2 and 3. A carriage rail 3 is fixed to the side frames 2 in the rear portion of the typewriter. The carriage rail 3 supports a carriage 4 in a manner that the carriage 4 is permitted to slidingly reciprocate in the transverse direction of the typewriter. A platen 5 is rotatably mounted on the carriage 4.

A top cover 6 covers a printing mechanism (only type bar 69 is partialy shown in FIG. 6) and a ribbon mechanism including a ribbon cartridge 7. The top cover 6 is supported by arm member 8 of substantially an inverted L- shape, each arm member 8 being pivotally supported on a shaft 8*a* which is fixed on the side frame 2. The arm members 8 are so adapted as to be swingable between a closed position shown by a solid line in FIG. 2 and an open position shown by a two-dotted line.

Respective arm member 8 is pivotally connected at its upper end with the front end of a support plate 9 fastened to the inner wall of the top cover 6, and if the arm members 8 are turned from the closed position to the open position, then the top cover 6 will be moved from a closed position shown by a solid line in FIG. 2 to an open position shown by a two-dotted line. The left arm member (not shown) is interconnected to the right arm member 8 by a connecting rod 10 in a manner to be integrally swingeable.

Figure 4:
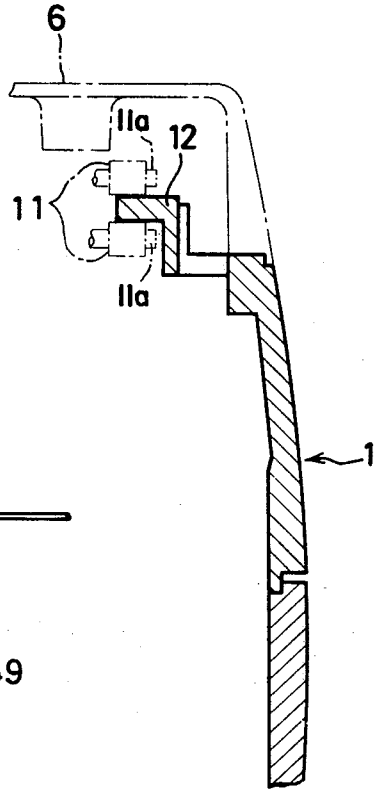
FIG. 4 is a fragmentary cross sectional view of a cover of the typewriter.

A pair of rollers 11 the lower one of which constitutes a returning actuator are rotatably mounted on each of shafts 11*a* on a rear end portin 9*a* extending rearward of the support plate 9, furthermore the lower roller 11 is pivotally mounted on the support plate 9 and is urged toward the upper roller 11 by the action of a spring 74 the pair of rollers 11 being in axially parallel relation to each other and spaced apart by a suitable distance from each other. A length of rib-shaped guide rail 12 projects on the inner wall of the cover 1, as shown by a one-dotted line in FIG. 2 and clearly illustrated in FIG. 4. The pair of rollers 11 are disposed in a manner to hold the guide rails 12 therebetween, and a vertical spacing between the rollers 11 is slightly larger than a thickness of the guide rail 12, so that when the front portion of the top cover 6 is moved by the swinging motion of the arm member 8, the rear portion of the top cover 6 may be moved smoothly through the mediary of the pair of rollers 11 along the guide rail 12.

A coil spring 13 is provided between the pin 14 fixed on the lower portion of the arm member 8 and a rigid piece 2*b* with a support plate 2*c* fixed to the side frame 2. The spring 13 normally urges the arm member 8 in the counterclockwise direction, as viewed in FIG. 2. A latching lever 15 is pivotally mounted on a rigid shaft 16 with a support plate 2*d* fixed to the side frame 2 and formed with a latching top portion 15*a* bent at a right angle with respect to the latching lever 15. The latching portion 15*a* is engageable with a shoulder 17 provided at the mid portion of the arm member 8. A spring 18 is provided between the latching lever 15 and the side frame 2 and normally urges the latching lever 15 in the counterclockwise direction in FIG. 2, to thereby maintain the latching portion 15*a* in engagement with the shoulder 17, whereby the arm member 8 is normally latched in the closed position against the force of the coil spring 13. A pin 19 is provided on the latching lever 15 in a portion slightly below the pivot shaft 16.

A wire 20 has a rear bent portion 20*a* of substantially a U-shape. The bent portion 20*a* is fitted with a pin 21 provided on the lower portion of the arm member 8 in a manner to permit movement of the pin 21 within the bent portion 20*a*. A buffer spring 22 is connected at one end to the front end of the wire 20 and at the other end to a pin 23 provided on the side frame 2. The buffer spring 22 remains in natural non-expanding status in the initial stage in which the arm member 8 has started turning in the counterclockwise direction under the action of the coil spring 13 as a result of disengagement of the shoulder portion 17 of the arm member 8 from the latching portion 15*a* of the latching lever 15. The buffer spring 22 will be extended when the pin 21 is shifted rightwards within the bent portion 20*a* as viewed in FIG. 2, and eventually brought into engagement with the right hand end of the bent portion 20*a*, with the progress of the turning of the arm member 8 in the counterclockwise direction. The buffer spring 22 serves to decelerate the speed of movement of the arm member 8 and top cover 6 accelerated by the force of coil spring 13, thereby preventing an abrupt movement of the top cover 6 toward an open position, as well as preventing an impact which might occur when the arm member 8 impinges against a stopper 70 on the side frame 2 .

In FIGS. 1 and 2, there is shown an operating lever 24 which constitutes a first operating means in combination with a push button 26. The operating lever 24 is pivotally supported on a short shaft 25 which is rigid with the side frame 2. The operating lever 24 has a rearwardly extending arm 24*b* and a downwardly extending arm 24*a*, thereby presenting substantially an inverted L-shape. The push button 26 for manipulating is rigidly mounted on the rearwardly extending arm 24*b* of the lever 24. If the push button 26 is manually depressed, then the operating lever 24 will be rotated in the clockwise direction as viewed in FIG. 2.

The downwardly extending arm 24*a* of the operating lever 24 has a pin 27 on its lower end portion, to which pin 27 is connected the front end of a wire 28. The wire 28 is formed with a threaded portion 28*a* in the rear portion. A forked coupling means 29 is secured onto the threaded portion 28*a* for adjustment of the length of the wire 28.

A retaining spring 31 is provided between the lever 30 and the side frame 2, which serves as retaining means, for retaining the lever 30 either in a second position as shown by a solid line in FIG. 2 or in a first position moved leftwards therefrom. The lever 30 is provided with a rectangular opening 30*a* nearly in the central portion thereof. Aforementioned pin 19 provided on the latching lever 15 is located in the rectangular opening 30*a*.

An actuating lever 32 having three arms 34, 36 and 60 is pivotally supported nearly in the central portion by a short shaft 33 fixed on the side frame 2. A downwardly extending first arm 34 of the actuating lever 32 is pivotally connected as at 35 to the rear end of the lever 30. A rearwardly extending second arm 36 of the actuating lever 32 has in the end portion a pin 37 which extends inwards of the typewriter. The pin 37 extends through an opening 38 provided in the side frame 2, as seen in FIGS. 1 and 2.

A universal bar 39 shown in FIGS. 1 and 3 is pivotally supported on a pair of shafts 39*a* fixed on the opposite side frames 2 (the right hand side frame 2 alone is shown).

The universal bar 39 is connected to the printing mechanism (not shown), which is urged in the counterclockwise direction by the action of a spring 40, and the universal bar 39 is adapted to be swung in the clockwise direction in FIG. 3 in response to operation of the printing mechanism. A rocker lever 41 is rotatably supported on a shaft 41*a* fixed on the side frame 2 and the rocker lever 41 is urged in the clockwise direction by the action of a spring 71 so that its lower end portion is engaged with the universal bar 39. An upper end portion of the rocker lever 41 is fastened to the upper end of a wire 42. A ribbon vibrator drive plate 43 is rotatably supported on a shaft 43*a* fixed on the side frame 2 and is urged in the counterclockwise direction by the action of a spring 44. The drive plate 43 is provided with a slot 45 of substantially a T-shape, in the lower portion thereof. The lower portion of the wire 42 passes through the slot 45, and then through an opening in a color-change plate 46. The color-change plate 46 serves to change the lower end of the wire 42 from one position to another proper position within the slot 45, and retains the lower end in that position.

Figure 5:
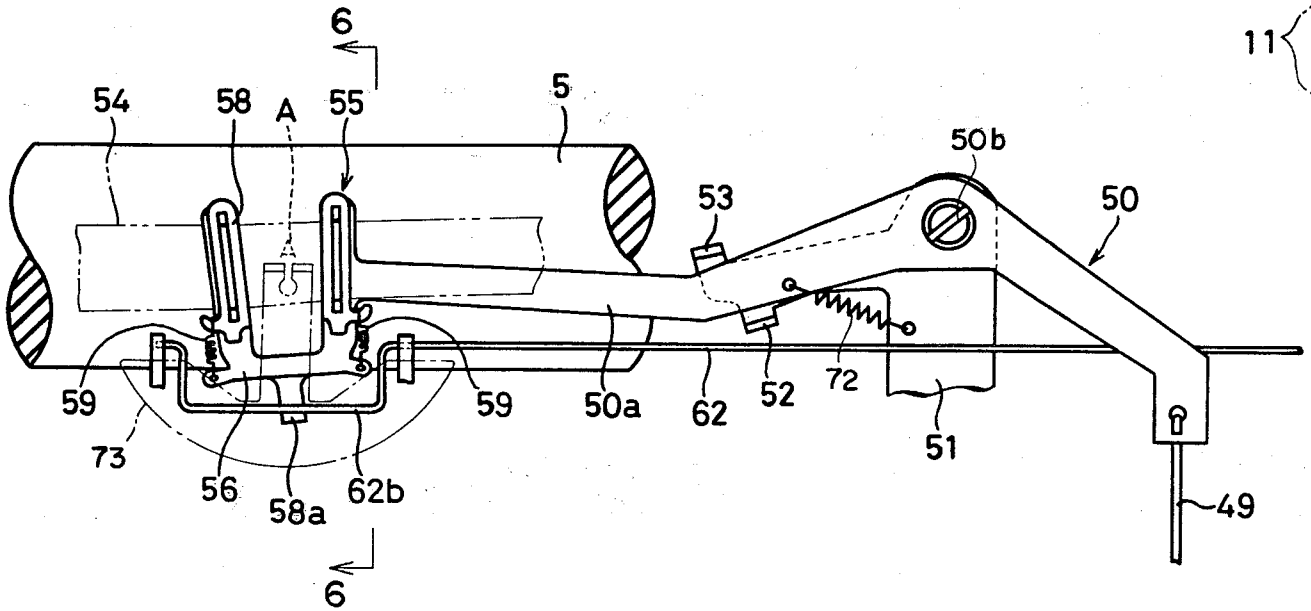
FIG. 5 is a fragmentary front view of a ribbon vibrator.

The drive plate 43 has a cam groove 47 in the upper portion thereof. The cam groove 47 is adapted to engage the pin 37 on the second arm 36 of the actuating lever 32. The cam groove 47 has a linearly inclined cam portion 47*a* which is near to the opening and an arcurate cam portion 47*b* which is connected with the linearly inclined cam portion 47*a*. When the actuating lever 32 is urged in the clockwise direction as viewed in FIG. 3, the pin 37 on the lever 32 will be brought into engagement with the inclined cam portion 47*a*, thereby the drive plate 43 is rotated in the clockwise direction. A radius of the arcurate cam portion 47*b* is equal to a distance between the short shaft 33 and the pin 37. More in detail, the drive plate 43 is rotated during the movement of the pin 37 along the inclined cam portion 47*a*, and the drive plate 43 is retained in that position which the plate 43 has been rotated during the movement of the pin 37 along the cam portion 47*b*. The drive plate 43 has a rearwardly extending, inclined arm 48, to which is fastened one end of a wire 49 as viewed in FIG. 3. The wire 49 is connected at the upper end to a ribbon vibrator 50. The ribbon vibrator 50, as best seen in FIG. 5, is rotatably supported on the shaft 50*b* fixed on the machine frame 51, and is urged in the counterclockwise direction by the action of a spring 72 but the extent of rotation of the ribbon vibrator 50 is limited by stoppers 52 and 53.

The ribbon vibrator 50 has an arm 50*a*, which extends leftwards along the platen 5, as viewed in FIG, 5, and which is formed at its left end with a ribbon retaining portion 55 for guiding and retaining a ribbon 54 fed from the ribbon cartridge 7. The ribbon vibrator 50 functions in the manner that so far as the longitudinal lower edge of the arm 50*a* of the ribbon vibrator 50 is maintained in contact with the stopper 52, by the action of the spring 72 the ribbon retaining portion 55 assumes the lowered non-printing position, and in turn is elevated to a printing position in front of the printing point A on the platen 5, in association with the printing operation. The printing point A is defined by a type bar guide 73 fixed on the machine frame, as viewed in FIGS. 5 and 6.

Figure 9:
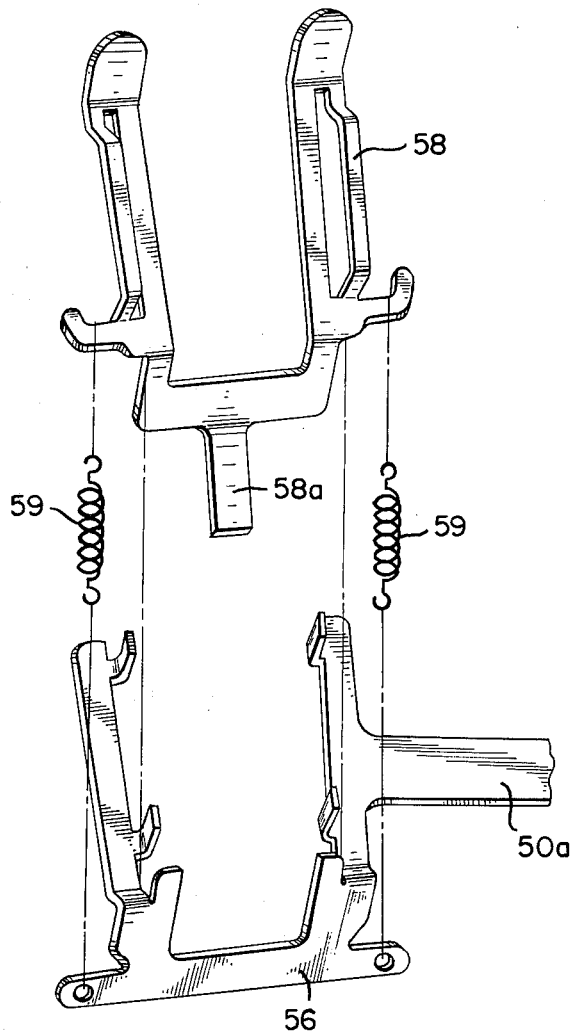
FIG. 9 is an exploded perspective view of the ribbon retaining portion.

The ribbon retaining portion 55 is comprised of a rear ribbon retaining member 56 which is substantially a U-shape and integral with the ribbon vibrator 50, and a front ribbon retaining member 58 of substantially a U-shape as seen in FIG. 9. The front ribbon retaining member 58 forms a pair of ribbon passages 57 in respective vertical portions of the U-shape having closed top and bottom portions when the front member 58 is laid exactly in front of the rear ribbon retaining member 56, as seen in FIG. 5 and FIG. 9.

Figure 7:
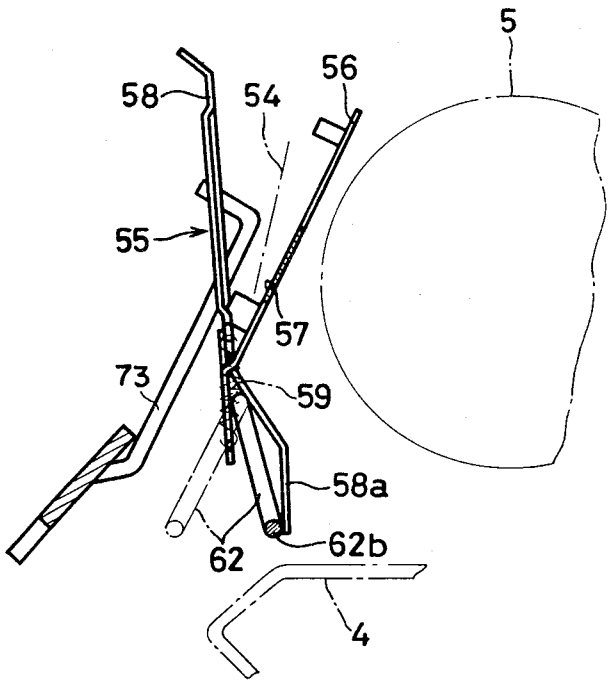
FIG. 7 is an illustration of operation of the portion corresponding to that of FIG. 6.
Figure 6:
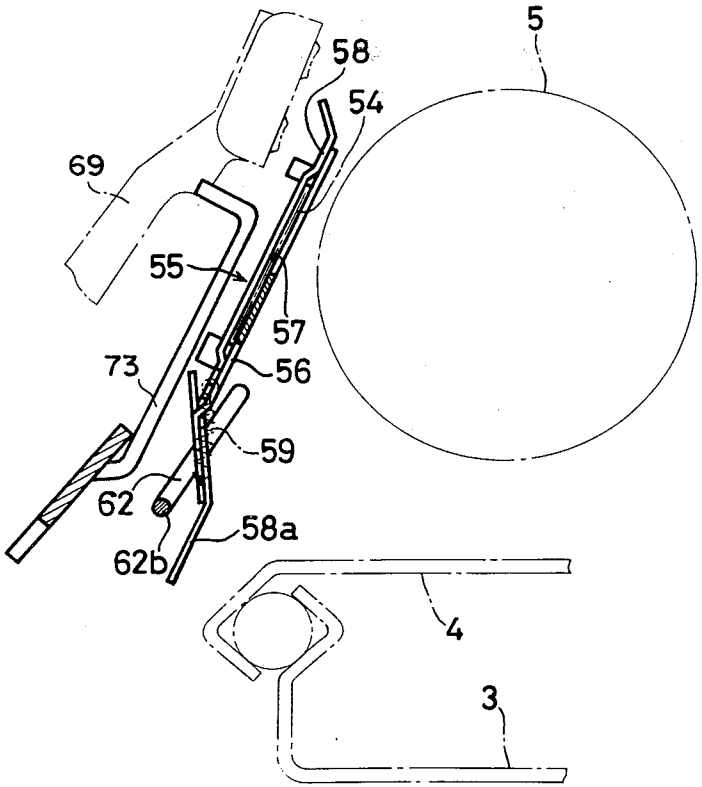
FIG. 6 is an enlarged cross sectional view taken along the line 6—6 of FIG. 5.

The front ribbon retaining member 58 is supported in a manner to swing between the two positions; one position is such that the member 58 stands in front of the rear ribbon retaining member 56, to thereby define the ribbon passages 57, as seen in FIG. 6, and the other position is such that the member 58 is biased from the rear portions of the ribbon vibrator lifts a printing ribbon from a lowered non-printing positions to an elevated the ribbon passages 57, as seen in FIG. 7. Both ribbon retaining members 56 and 58 are normally urged in the direction of defining the ribbon passages 57 under the action of springs 59, which are provided between these two members 56 and 58, respectively, as seen in FIG. 6. The front ribbon retaining member 58 has a pendent projection 58*a* in the lower central portion thereof.

A pin 61 is fixed to the end portion of the upwardly extendingly, inclined third arm 60 of the actuating lever 32. The pin 61 is adapted to engage the bent portion 62*a* of the opener shaft 62, as seen in FIG. 2. The opener shaft 62 is rotatably supported at one end on the side frame 2 as at 2*a*, and normally urged in the clockwise direction as viewed in FIG. 2, by the action of a spring 63, into engagement with the pin 61 on the actuating lever 32.

The opener shaft 62 extends leftwards in parallel with the platen 5 and is formed with a U-shaped bent portion 62*b* surrounding the lower portion of the ribbon retaining portion 55, as seen in FIG. 5. The opener shaft 62 is supported on the machine frame, on each side of the U-shaped bent portion 62*b*, so that if the opener shaft 62 is rotated in the counterclockwise direction by the actuating lever 32, then the U-shaped bent portion 62*b* comes to engage with the pendent projection 58*a* of the front ribbon retaining member 58, thereby turning the front retaining member 58 in the counterclockwise direction, whereby the top portions of the ribbon passages 57 are rendered open.

A return lever 64 as shown in FIG. 2 is pivotally supported in its lower portion as at 65 on the actuating lever 32. The returning lever 64 provides an arcurate slot 66 above the pivot point 65, and the short shaft 33 is fitted in the arcurate slot 66. The returning lever 64 is normally urged in the clockwise direction by the force of a spring 67, as viewed in FIG. 2, and retained in a position where the short shaft 33 engages the left end of the arcurate slot 66, as seen in FIG. 2.

Figure 8:
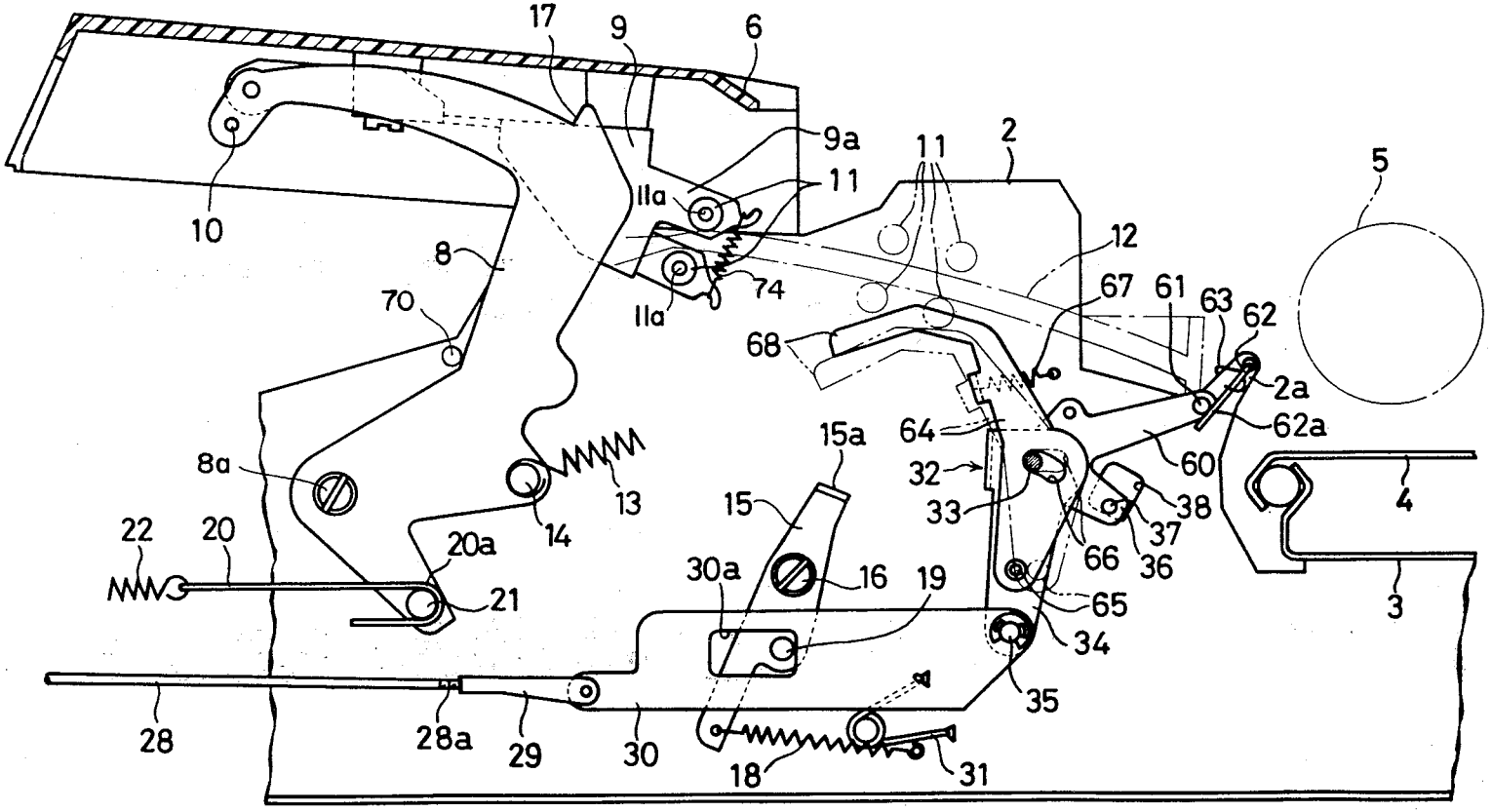
FIG. 8 illustrates operation of the ribbon changing mechanism when the top cover assumes the open position, which corresponds to FIG. 2.

The returning lever 64 has an upper arcurate cam arm 68 which extends leftward. The cam arm 68, as seen in FIG. 8, serves to return the actuating lever 32 from the first position thereof to the second position in FIG. 2 and is adapted to engage the lower one of rollers 11 of the top cover 6.

In operation, when it is desired for a machine operator to exchange a ribbon cartridge 7 for a new one, the operator depresses the push button 26, whereby the operating lever 24 is rotated in the clockwise direction as viewed in FIG. 2 thereby displacing the lever 30 leftward through the mediary of the wire 28. This movement of the lever 30 causes the actuating lever 32 to rotate in the clockwise direction into a first position. At this time, the retaining spring 31 retains the lever 30 and the actuating lever 32 in their first positions shown in FIG. 8, respectively.

With the turning of the actuating lever 32 in the clockwise direction, the drive plate 43 is rotated in the clockwise direction as viewed in FIG. 3, under cooperation of the pin 37 on the second arm 36 with the cam groove 47, whereby the ribbon vibrator 50 is rotated in the clockwise direction through the mediary of the wire 49, as viewed in FIG. 5. Consequently, the ribbon retaining portion 55 is upwardly shifted from the lowered, non-printing position to an elevated position.

Simultaneously with the above movement, the opener shaft 62 is rotated in the counterclockwise direction through the mediary of the pin 61 against the force of the spring 63, as viewed in FIG. 2. As a result of the rotation of the opener shaft 62, the U-shaped bent portion **62*b* of the opener shaft 62 is brought into engagement with the pendent projection 58*b* of the front ribbon retaining member 58, thereby urging the member 58 in the counterclockwise direction as viewed in FIG. 7, with its lower portion maintained aligned on the rear retaining member 56, whereby the top portions of the ribbon passages 57 assumes an open state, thus facilitating removal of the ribbon 54 from the ribbon retaining portion 55**.

After a certain interval of time from the beginning of the leftward movement of the lever 30 in FIG. 2 by depressing the push button 26, the pin 19 on the latching lever 15 will be brought into engagement with the right-hand edge of the opening **30*a*, thereby turning the latching lever 15 in the clockwise direction. As a result, the latching portion 15*a* of the latching lever 15 disengages from the shoulder 17 of the arm member 8, whereby the arm member 8 is urged in the counterclockwise direction by the action of the coil spring 13, thereby moving the top cover 6 from the closed position shown by a solid line in FIG. 2** to the open position shown by a two-dotted line.

The buffer spring 22 will be extended when the pin 21 on the arm member 8 is brought into engagement with the bent portion **20*a* of the wire 20 with the progress of the turning of the arm member 8. The buffer spring 22 serves to decelerate the speed of movement of the arm member 8 and top cover 6 accelerated by the force of the coil spring 13**.

During the movement of the top cover 6 to the open position, the lower one of the rollers 11 will contact the upper longitudinal edge of the cam arm 68 of the returning lever 64. This, however, does not interfere with the movement of the actuating lever 32 toward the first position, because the return lever 64 is permitted to turn in the counterclockwise direction within the arcurate slot 66, relative to the actuating lever 32, After exchanging a used ribbon cartridge 7 for a new one, the top cover 6 is manually moved from its open position to its closed position against the force of the spring 13, then the pair or rollers 11 on the support plate 9 will be returned from the position shown by a solid line in FIG. 8, via the positions shown by a one-dotted line, to the home position shown in FIG. 2. During the travel of the pair of rollers 11 from the position shown by the one-dotted line to the position shown by the two-dotted line, the lower roller 11 engages the cam arm 68, thereby pushing the cam arm 68 downward, whereby the returning lever 64 is turned about the short shaft 33 in the counterclockwise direction. The returning lever 64 and the actuating lever 32 are connected to each other by a pivot 65, such that the actuating lever 32 is also turned about the short shaft 33 in the counterclockwise direction. Consequently, the actuating lever 32 and the lever 30 will be returned to the second positions from the first positions in which both have been retained by the retaining spring 31, and respectively retained in their home positions by the force of the retaining spring 31.

With the returning motion of the actuating lever 32 to its second position, the pin 37 on the first arm 36 disengages from the cam groove 47 of the drive plate 43, whereby the drive plate 43 is urged by the force of the spring 44 in the counterclockwise direction, and hence the ribbon vibrator 50 is turned in the counterclockwise direction as viewed in FIG. 5, thereby returning the ribbon retaining portion 55 from the ribbon changing position to the lowered, non-printing position. On the other hand, the opener shaft 62 which has been retained to rotated position by the pin 61 on the third arm 60, is urged by the force of the spring 63 to its home position as shown in FIG. 2, whereby the front ribbon retaining member 58 is returned to its home position so as to close the top portion of the ribbon passage 57 defined by the combination of the rear ribbon retaining member 56 and the front ribbon retaining member 58. Thus, the ribbon 54 is guided in a usual manner with the freedom from being slipped off the ribbon retaining portion 55 due to the vertical motion of the ribbon vibrator 50.

As a result of the returning motion of the lever 30 from its first position, the latching lever 15 is urged by the action of the spring 18 in the counterclockwise direction as viewed in FIG. 8, thereby bringing the latching portion **15*a* into engagement with the shoulder 17 of the arm member 8 thus returned to its home position, whereby the top cover 6 is retained in place in the closed position relative to the typewriter. Due to the returning motion of the lever 30, the button 26 is brought into its home position by means of the wire 28 and the operating lever 24**.

We claim:

1. In a typewriter having a machine frame, a top cover movably supported on said machine frame between an open position and a closed position, and a ribbon vibrator vertically movable between a lifted printing position and a lowered non-printing position, in response to a printing operation, a ribbon changing mechanism comprising:

(a) an actuating member operably connected with said ribbon vibrator to shift said ribbon vibrator between said lowered position and a ribbon changing position located above said lowered position, independently of the printing operation;

(b) a first operating means for moving said actuating member to a first position where said ribbon vibrator is shifted to said ribbon changing position;

(c) means for retaining said actuating member in one of said first position and a second position where said ribbon vibrator is shifted to said lowered position;

(d) a ribbon retaining portion including a rear ribbon retaining member and a front ribbon retaining member on said ribbon vibrator, said front ribbon retaining member defining a pair of ribbon passages including closed top and bottom portions in combination with said rear ribbon retaining member, said front ribbon retaining member being supported on a lower portion of said ribbon vibrator to be movable toward a direction for opening said closed top portions of said ribbon passages;

(e) an opener pivotally mounted on said machine frame to be engagable with said front ribbon retaining member and operably connected with said actuating member, said front ribbon retaining member being moved to open said closed top portions of said ribbon passages when said actuating member is shifted to said first position by the operation of said first operating means;

(f) a guide member provided on said machine frame for guiding the opening and closing movements of said top cover;

(g) a returning actuator provided on said top cover for returning said actuating member to said second position; and, (h) a second operating means including said top cover and a returning member operably connected with said actuating member, said returning member having a cam portion engagable with said returning actuator for returning said actuating member to said second position by the closing movement of said top cover.

2. A ribbon changing mechanism for a typewriter as efined in claim 1 wherein:

said top cover is supported by a pair of arm members, one of said arm members having a shoulder portion;

a spring member for urging said arm member toward the direction of said open position of said top cover; and, a latching member rotatably mounted on said machine frame and operably connected with said first operating means, said latching member being engagable with said shoulder portion of said one arm member for latching said one arm member to a position where said top cover is held in said closed position against the urging force of said spring member.

3. A ribbon changing mechanism for a typewriter as defined in claim 1 wherein:

said guide member is formed by a length of rib-shape rail member projected on the inner wall of said machine frame;

a pair of roller members mounted on said top cover, in axially parallel relation to each other and disposed in a manner to hold said rail member; and said returning actuator is formed of one of said roller members.

4. A ribbon changing mechanism for a typewriter as defined in claim 2 including:

a buffer spring provided between said one arm member and said machine frame for damping the movement of said one arm member and said top cover toward said open position by said spring member; and, means for actuating said buffer spring on the tranveling movement of said one arm member and said top cover toward said open position.

* * * * *